US009359891B2

(12) United States Patent
Galvan-Sanchez et al.

(10) Patent No.: US 9,359,891 B2
(45) Date of Patent: Jun. 7, 2016

(54) LWD IN-SITU SIDEWALL ROTARY CORING AND ANALYSIS TOOL

(71) Applicants: Francisco Galvan-Sanchez, Houston, TX (US); Olufemi A. Adegbola, Dubai (AE); Chris Morgan, Spring, TX (US); Gigi Zhang, Cypress, TX (US); Matthias Meister, Celle (DE)

(72) Inventors: Francisco Galvan-Sanchez, Houston, TX (US); Olufemi A. Adegbola, Dubai (AE); Chris Morgan, Spring, TX (US); Gigi Zhang, Cypress, TX (US); Matthias Meister, Celle (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 716 days.

(21) Appl. No.: 13/676,225

(22) Filed: Nov. 14, 2012

(65) Prior Publication Data

US 2014/0131033 A1 May 15, 2014

(51) Int. Cl.

| | |
|---|---|
| ***E21B 49/02*** | (2006.01) |
| ***E21B 49/00*** | (2006.01) |
| ***E21B 49/06*** | (2006.01) |
| ***E21B 49/10*** | (2006.01) |

(52) U.S. Cl.

CPC ..... *E21B 49/00* (2013.01); *E21B 49/06* (2013.01); *E21B 49/10* (2013.01)

(58) Field of Classification Search

CPC ..... E21B 49/02; E21B 49/08

See application file for complete search history.

(56) References Cited

U.S. PATENT DOCUMENTS

| | | | | |
|---|---|---|---|---|
| 7,191,831 | B2 | 3/2007 | Reid et al. | |
| 7,500,388 | B2 | 3/2009 | Fujisawa et al. | |
| 7,530,407 | B2 | 5/2009 | Tchakarov et al. | |
| 7,762,328 | B2 | 7/2010 | Tchakarov | |
| 8,141,419 | B2 | 3/2012 | Tchakarov et al. | |
| 8,171,990 | B2 | 5/2012 | Tchakarov et al. | |
| 2006/0000606 | A1 | 1/2006 | Fields et al. | |
| 2009/0164128 | A1 | 6/2009 | Tchakarov et al. | |
| 2009/0250214 | A1 | 10/2009 | Simpson | |
| 2010/0095758 | A1 * | 4/2010 | Georgi et al. | 73/152.28 |
| 2013/0081803 | A1 * | 4/2013 | Tao et al. | 166/247 |

OTHER PUBLICATIONS

Rotary Sidewall Coring, Mar. 2010 [retrieved on Nov. 12, 2012]. Retrieved from the internet:, URL:http://www.bakerhughes.com/products-and-services/evaluation/coring-services/wireline-s . . . .

Notification of Transmittal of the International Search Report and the Written Opinion of the International Searching Authority, or the Declaration; PCT/US2013/069149; Mailed Feb. 17, 2014, 12 pages.

* cited by examiner

*Primary Examiner* — William P Neuder

(74) *Attorney, Agent, or Firm* — Cantor Colburn LLP

(57) ABSTRACT

An apparatus for estimating a property of an earth formation includes a carrier configured to be conveyed through a borehole penetrating the formation and a single probe configured to be extended from the carrier and to seal with a wall of the borehole. The apparatus further includes a fluid analysis sensor disposed at the carrier and configured to sense a property of a formation fluid sample extracted from the formation by the probe. A coring device is disposed at the carrier and configured to extend into the probe, to drill into the wall of the borehole, and to extract a core sample. A core sample analysis sensor is disposed at the carrier and configured to sense a property of the core sample. A processor is configured to receive data from the fluid analysis sensor and the core sample analysis sensor and to estimate the property using the data.

19 Claims, 4 Drawing Sheets

LWD IN-SITU SIDEWALL ROTARY CORING AND ANALYSIS TOOL

BACKGROUND

Earth formations may be used for many purposes such as hydrocarbon production, geothermal production and carbon dioxide sequestration. Drilling boreholes into the earth formations in order to gain access can be very expensive. Therefore, it is important to efficiently use existing drilling resources and to correctly characterize the formations before committing more resources.

One technique used to characterize a formation is to convey a logging tool through a borehole penetrating the formation. The logging tool is designed to perform measurements on the formation from within the borehole using one or more sensors disposed in the logging tool. There may be limits to the accuracy of properties determined from data from these sensors due to remote sensing from within the tool. Hence, it would be well received in the drilling industry if downhole characterization tools could be improved.

BRIEF SUMMARY

Disclosed is an apparatus for estimating a property of an earth formation. The apparatus includes: a carrier configured to be conveyed through a borehole penetrating the formation; a single probe configured to be extended from the carrier and to seal with a wall of the borehole; a fluid analysis sensor disposed at the carrier and configured to sense a property of a formation fluid sample extracted from the formation by the probe; a coring device disposed at the carrier and configured to extend into the probe, to drill into the wall of the borehole, and to extract a core sample; a core sample analysis sensor disposed at the carrier and configured to sense a property of the core sample; and a processor configured to receive data from the fluid analysis sensor and the core sample analysis sensor and to estimate the property using the data.

Also disclosed is a method for estimating a property of an earth formation. The method includes: conveying a carrier through a borehole penetrating the earth formation; extending a single probe from the carrier to a wall of the borehole and sealing to the wall of the borehole; extracting a formation fluid sample through the probe; analyzing the fluid sample using a fluid analysis sensor disposed at the carrier; extracting a core sample from the earth formation through the probe using a coring device; analyzing the core sample using a core sample analysis sensor disposed at the carrier; and estimating the property using a processor that receives data from the fluid analysis sensor and the core sample analysis sensor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the Figures.

Disclosed are apparatus and method for characterizing an earth formation. The apparatus and method relate to using a downhole tool or system having sensors for measuring properties of the formation. When certain characteristics are indicated by the measurements, then a formation fluid and a core sample are extracted. The extracted samples are analyzed downhole and stored for laboratory analysis after the downhole tool is removed from the borehole. Non-limiting examples of properties measured and/or determined by the tool include chemical composition, density, viscosity, acoustic impedance, and electrical resistivity.

Figure 1:
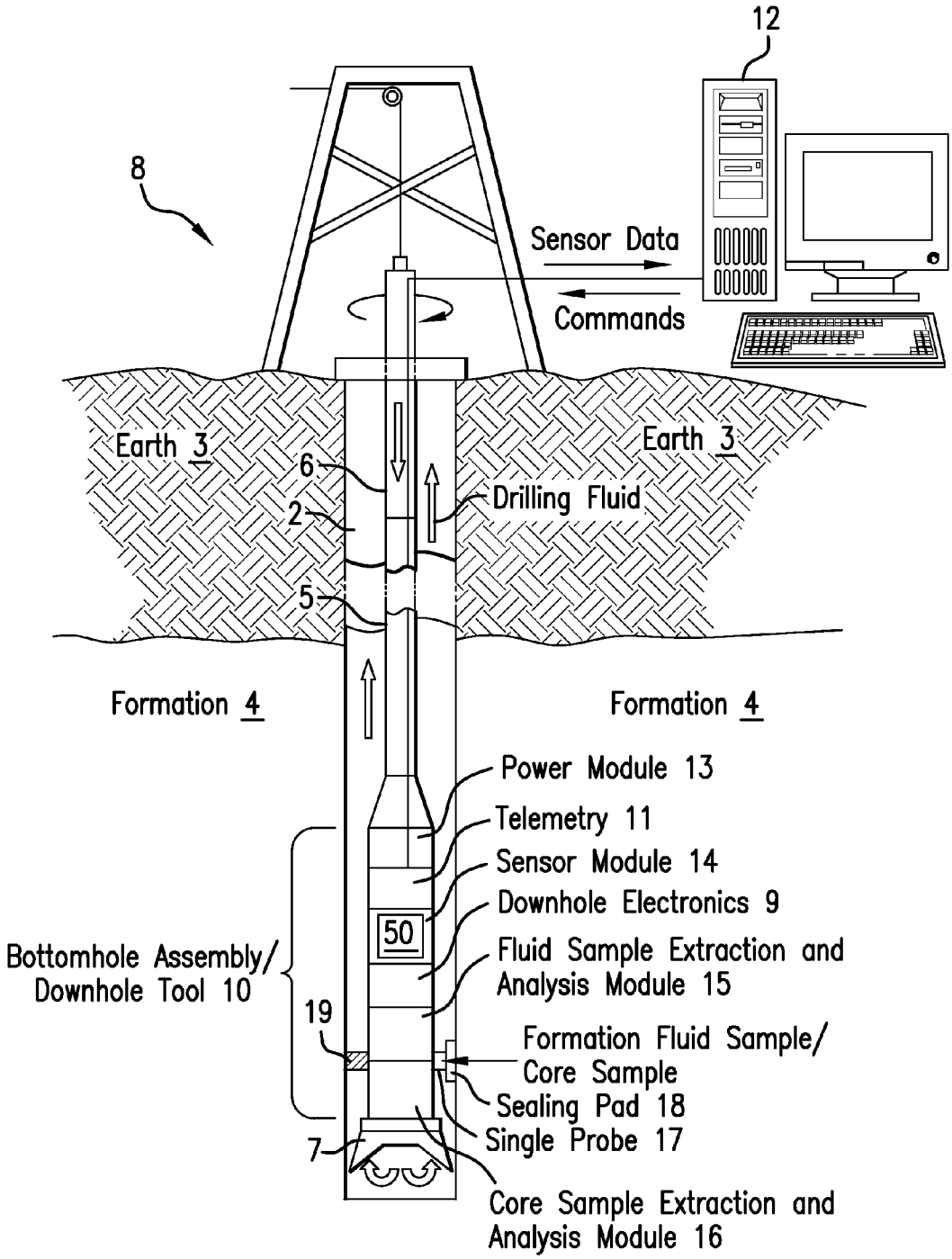
FIG. 1 illustrates an exemplary embodiment of a while-drilling tool disposed in a borehole penetrating an earth formation.

FIG. 1 illustrates a cross-sectional view of an exemplary embodiment of a system to estimate a property of an earth formation. A bottomhole assembly (BHA) 10 is disposed in a borehole 2 penetrating the earth 3, which includes an earth formation 4. The earth formation 4 represents any subsurface material of interest that is intended to be characterized. The BHA 10, which may be referred to as a downhole tool 10, includes modules, devices and components that are used to characterize or estimate a property of the formation 4.

The BHA 10 is conveyed through the borehole by a carrier 5. In the embodiment of FIG. 1, the carrier 5 is a drill string 6 (or drill tubular) in an embodiment referred to as logging-while-drilling (LWD) or measurement-while-drilling (MWD). Disposed at a distal end of the drill string 6 is a drill bit 7. A drilling rig 8 is configured to conduct drilling operations such as rotating the drill string 6 and thus the drill bit 7 in order to drill the borehole 2. In addition, the drilling rig is configured to pump drilling fluid through the drill string 6 in order to lubricate the drill bit 7 and flush cuttings from the borehole 2. Downhole electronics 9 may be configured to operate the modules, devices and components of the BHA 10, process data obtained downhole, or provide an interface with telemetry 11 for communicating with a computer processing system 12 disposed at the surface of the earth 3. Non-limiting embodiments of the telemetry 11 include mud-pulse telemetry and wired drill pipe. The telemetry 11 is configured to communicate information, data, or commands between the modules, devices, and components of the BHA 10 and the computer processing system 12. Operating, controlling or processing operations may be performed by the downhole electronics 9, the computer processing system 12, or a combination of the two. While the modules, devices and components of the BHA 10 are shown in the BHA 10, they may also be disposed at other locations along the carrier 5.

In the embodiment of FIG. 1, the BHA 10 includes a power module 13, a sensor module 14, a fluid sample extraction and analysis module 15, and a core sample extraction and analysis module 16. The power module 13 is configured to supply power, such as electrical or hydraulic power, to the BHA 10. The fluid extraction and analysis module 15 is configured to extract a sample of fluid from the formation 4 and to analyze and/or store the sample for later analysis. In addition, the module 15 may also be configured to measure the formation 4 pressure. The core extraction and analysis module 16 is configured to extract a core sample of the formation 4 and to analyze and/or store the core sample for later analysis. Both the fluid extraction and analysis module 15 and the core extraction and analysis module 16 use a single common probe 17 that is configured to extend from the BHA 10 and seal against a wall of the borehole 2. The probe may also include a sealing pad 18 that is deformable to aid in sealing against the borehole wall. The sealing pad 18 prevents annular fluid form contaminating fluid and core samples. Both fluid samples and the core samples are obtained through the probe 17. The BHA 10 also includes a brace 19 configured to extend from the BHA 10 and to provide sufficient support for the probe 17 to seal against the borehole wall.

In one or more embodiments, the power module 13 includes a turbine and electric generator where the turbine interacts with the flow of the drilling fluid in the drill string 6 to turn the electric generator to generate electrical power. In one or more embodiments, the power module 13 includes a turbine and hydraulic generator where the turbine interacts with the flow of the drilling fluid in the drill string 6 to turn the hydraulic generator to generate hydraulic power.

The sensor module 14 includes one or more sensors 50. The sensors 50 are configured to sense or measure a property of the formation 4 from within the BHA 10. Data from these sensors may be transmitted continuously to an operator or petro-analyst for analysis at the surface using the telemetry 11. Non-limiting embodiments of the sensors 50 include a pressure sensor, a temperature sensor, a gravimeter (which may be used to determine true vertical depth or formation properties), a radiation detector, a neutron source to be used in conjunction with the radiation detector, a nuclear magnetic resonance sensor, an acoustic sensor, and an electrical resistivity sensor.

Figure 2:
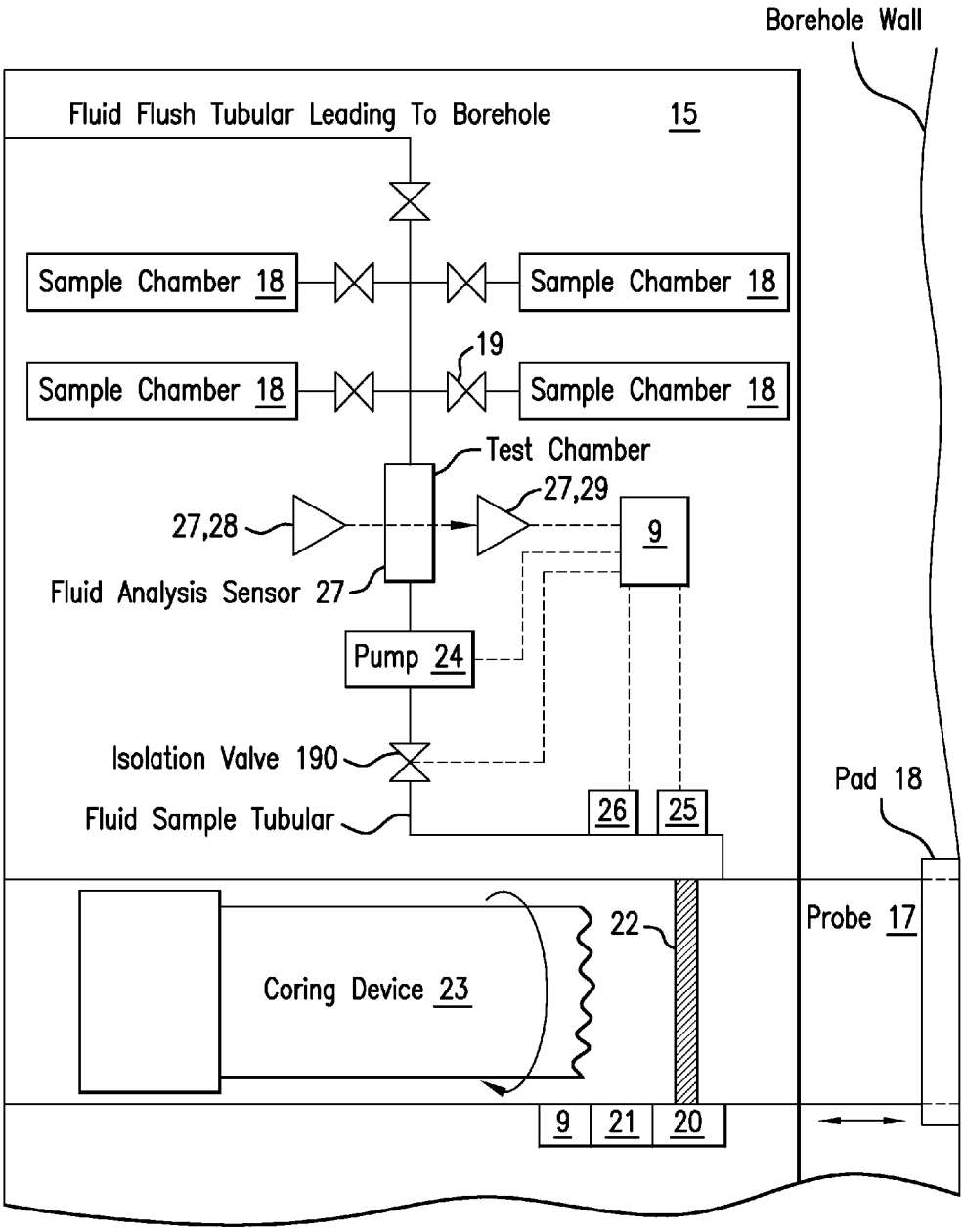
FIG. 2 depicts aspects of fluid analysis portion of a formation analysis module included in the while-drilling tool.

Reference may now be had to FIG. 2, which depicts aspects of the fluid sample extraction and analysis module (FSEAM) 15 and the probe 17 in a cross-sectional view. A linear actuator 20 is configured to apply a force to the probe 17 to cause the probe 17 to extend from the BHA 10. The linear actuator 20 may include a force sensor 21 that is configured to measure the force or pressure exerted by the probe 17 against the borehole wall. The force sensor 21 may input a signal to a controller, such as may be included in the downhole electronics 9, so that the controller can provide feedback control of the linear actuator 20. The feedback control provides for the probe 17 maintaining a constant force against the borehole wall in order to maintain the seal. A remotely operated door 22 is provided to isolate a coring device 23 from fluid extracted and analyzed by the FSEAM 15.

The FSEAM 15 includes a pump 24, pressure sensor 25, and a flow sensor 26. The pump 24 is configured to pump formation fluid from the formation 4, through the probe 17 and into the FSEAM 15. The pressure sensor 25 is configured to sense the pressure of the formation fluid when it starts to flow (as sensed by the flow sensor 26) in order to determine the pressure of the formation 4. The flow sensor 26 provides an indication of an amount of fluid flow in order to flush out the FSEAM 15 of any borehole fluid before obtaining a clean formation fluid sample. A fluid analysis sensor 27, which may include a test chamber, is configured to sense or measure a property of the fluid sample. Non-limiting embodiments of the fluid analysis sensor include a temperature sensor, a transmissive spectroscopy sensor, reflective spectroscopy sensor, and a flexural mechanical resonator (such as a piezoelectric tuning fork). Spectroscopy sensors include a light source 28 and a photodetector 29. In transmissive spectroscopy, the photodetector 29 receives light that is transmitted through the fluid sample. In reflective spectroscopy, the photodetector 29 receives light that is reflected by the fluid sample. The light received by the photodetector 29 is then analyzed and correlated to a property such as chemical composition of the fluid sample. The flexural mechanical resonator resonates or vibrates in the fluid sample with a characteristic that can be correlated to a property (such as density or viscosity) of the fluid sample.

The FSEAM 15 also includes one or more fluid sample chambers 18. Each fluid sample chamber 18 is configured to contain a fluid sample at downhole conditions of pressure and/or temperature. Each sample chamber may be insulated and have heating and/or cooling elements and a controller configured to maintain the core samples at downhole conditions. Remotely operated valves 19 are used to isolate the sample chambers 18 after fluid samples is disposed in respective sample chambers 18. In one or more embodiments, a remotely operated isolation valve 190 is used to isolate the FSEAM 15 when a core sample is being extracted by the coring device 23.

Figure 3:
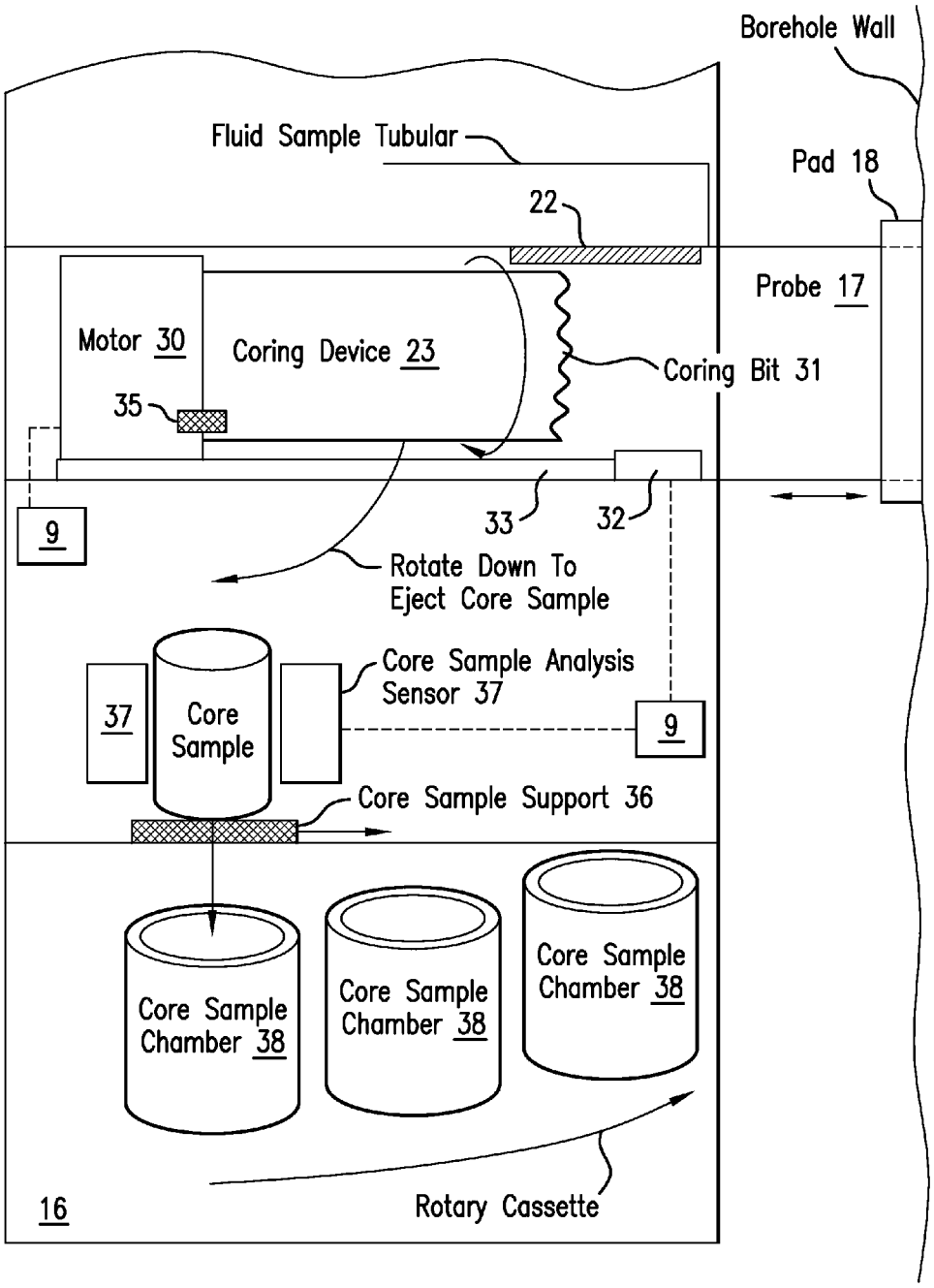
FIG. 3 depicts aspects of core sample analysis portion of the formation analysis module.

Reference may now be had to FIG. 3, which depicts aspects of the core sample extraction and analysis module (CSEAM) 16 and the coring device 23. The coring device 23 includes a motor 30 configured to rotate a hollow coring bit 31 for drilling into the formation 4 and extracting a core sample into the hollow region of the coring bit 31. In one or more embodiments, the motor 30 is a direct-drive brushless electric motor, which provides precise control of the core drilling operation for more efficient and reliable core drilling. A linear drive motor 32 with drive linkage 33 such as a screw-drive is configured to urge the coring device towards the formation 4 for drilling into the formation 4. Upon extraction of the core sample, the linear drive motor 32 withdraws the coring device 23 containing the core sample back into the CSEAM 16. The coring device 23 and coring bit 31 are configured to rotate down about 90 degrees once the coring device is withdrawn into the CSEAM 16. Once the coring bit 31 is rotated down, a piston 35 extends to eject the core sample onto a core sample support 36. The core sample support 36 is configured to support the core sample in a certain position for analysis measurements by one or more core sample analysis sensors 37. Non-limiting embodiments of the core sample analysis sensor 37 include a nuclear magnetic resonance sensor, an acoustic sensor, a radiation detector, a neutron source (which is used in conjunction with the radiation detector), and an electrical resistivity sensor. Core sample measurements are provided to the downhole electronics 9 and/or the computer processing system 12 for processing.

After measurements of the core sample are completed, the core sample support 36 moves to allow the core sample to be deposited into a core sample container 38, which is configured to maintain the deposited core sample at downhole conditions such as pressure and temperature. In one or more embodiments, a plurality of the core sample containers is configured as a rotating cassette where once the core sample is deposited, the cassette rotates to cover the opening of core sample container that was just filled and to place an unfilled core sample container 38 into position to receive the next core sample. The core sample containers 38 may be insulated and have heating and/or cooling elements and a controller configured to maintain the core samples at downhole conditions.

It can be appreciated that the downhole tool 10 has several advantages. One advantage is that more accurate measurements may be performed on extracted samples due to their close proximity to sensors than would be possible with sensors that are more remote to the formation materials being sensed. Another advantage is that several fluid and core samples may be extracted at different formation depths during short halts in drilling without requiring removal of a sample tool from a borehole every time a sample is taken, thus optimizing the use of drilling resources. In one or more embodiments, all formation testing and sampling can be performed in one pass through the borehole by the downhole tool 10. Yet another advantage is that the downhole tool 10 uses the single probe 17 for extracting both a fluid sample and a core sample. The use of a single probe provides for a more compact downhole tool 10 that can fit within the constraints of the borehole 2 and the drill string 6. In addition, the use of a single probe provides for a core sample to be extracted before a fluid sample is extracted, thereby limiting any mud infiltrate invasion during fluid sampling (because the mud infiltrate invasion zone in the core sample will be extracted with the core sample) and also providing a shorter path to the probe for the virgin formation fluid to flow. Yet another advantage is that both a fluid sample and a core sample can be obtained in highly deviated or horizontal boreholes. Yet another advantage is the ability to obtain petrophysical measurements from which reservoir quality and producibility may be predicted especially in carbonates where it is a well-known challenge. Yet another advantage is that an operator or petro-analyst at the surface of the earth can continuously monitor sensor measurements performed on the formation 4 by sensors in the sensor module 14. When these sensors indicate a characteristic or property of interest to the petro-analyst, the operator can send a command to the downhole tool 10 to obtain a fluid sample and a core sample and to perform measurements on the samples. Hence, the operator and petro-analyst can make more efficient use of drilling resource resources by avoiding locations in the formation 4 that may not be of interest.

Figure 4:
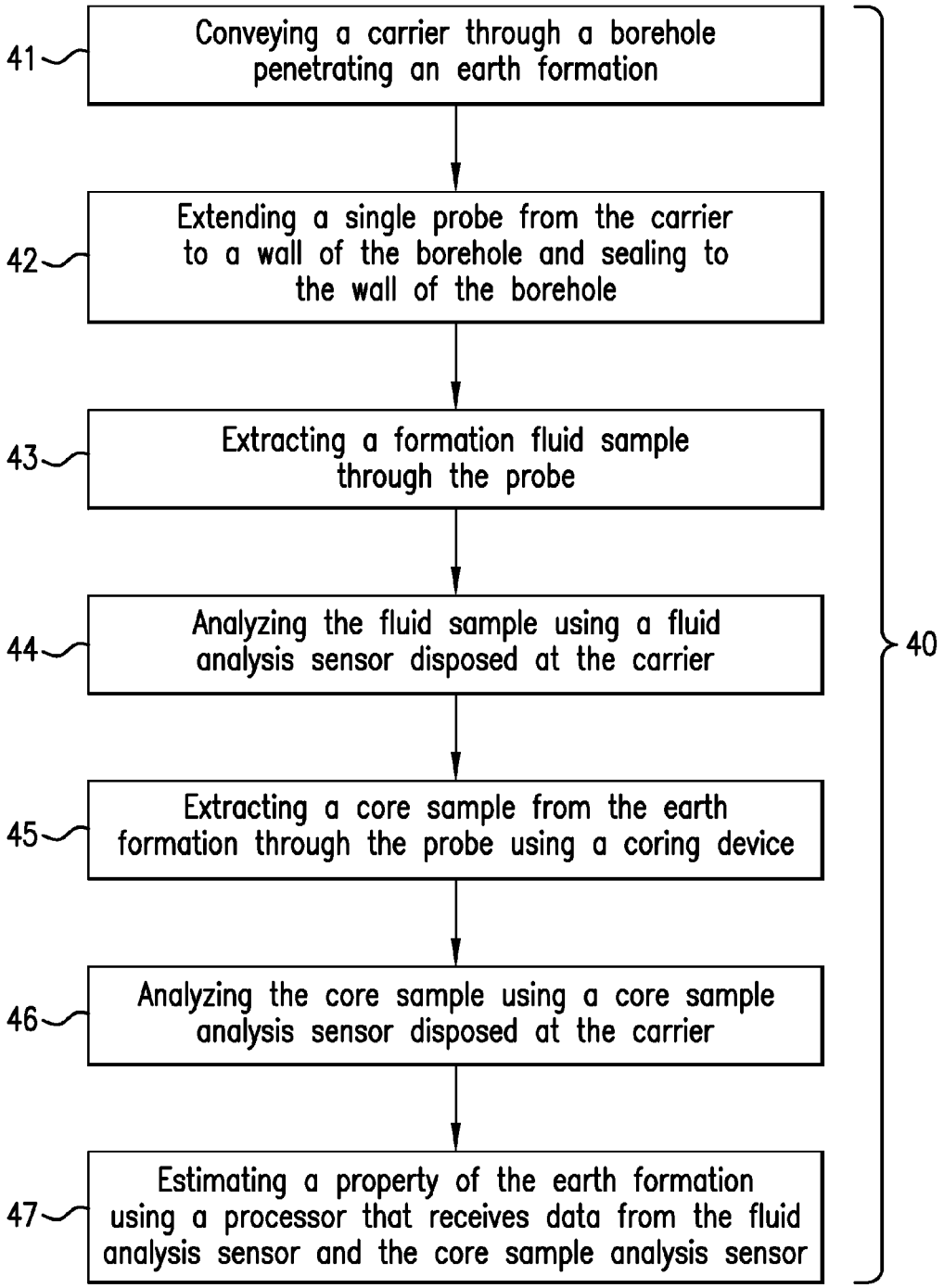
FIG. 4 is a flow chart of a method for estimating a property of an earth formation.

FIG. 4 is a flow chart for a method 40 for estimating a property of an earth formation. Block 41 calls for conveying a carrier through a borehole penetrating the earth formation. Block 42 calls for extending a single probe from the carrier to a wall of the borehole and sealing to the wall of the borehole. Block 43 calls for extracting a formation fluid sample through the probe. Block 44 calls for analyzing the fluid sample using a fluid analysis sensor disposed at the carrier. Block 45 calls for extracting a core sample from the earth formation through the probe using a coring device. Block 46 calls for analyzing the core sample using a core sample analysis sensor disposed at the carrier. Block 47 calls for estimating the property using a processor that receives data from the fluid analysis sensor and the core sample analysis sensor. It can be appreciated that the steps of the method 40 may be performed in various sequential orders. In one or more embodiments, fluid sampling and analysis related to blocks 43 and 44 are performed before core sampling and analysis related to blocks 45 and 46 are performed. In one or more embodiments, core sampling and analysis related to blocks 45 and 46 are performed before fluid sampling and analysis related to blocks 43 and 44 are performed. It may be advantageous to perform core sampling and analysis before fluid sampling and analysis because removing a core sample from the formation will limit the amount of mud infiltrate invasion during fluid sampling and also provide a shorter path for the virgin formation fluid.

In support of the teachings herein, various analysis components may be used, including a digital and/or an analog system. For example, the downhole electronics 9, the telemetry 11, the surface computer processing 12, the FSEAM 15, the fluid analysis sensor 27, the CSEAM 16, or the core sample analysis sensor 37 may include the digital and/or analog system. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

The term "carrier" as used herein means any device, device component, combination of devices, media and/or member that may be used to convey, house, support or otherwise facilitate the use of another device, device component, combination of devices, media and/or member. Other exemplary non-limiting carriers include drill strings of the coiled tube type, of the jointed pipe type and any combination or portion thereof. Other carrier examples include casing pipes, wirelines, wireline sondes, slickline sondes, drop shots, bottom-hole-assemblies, drill string inserts, modules, internal housings and substrate portions thereof.

The flow diagram depicted herein is just an example. There may be many variations to this diagram or the steps (or operations) described therein without departing from the spirit of the invention. For instance, the steps may be performed in a differing order, or steps may be added, deleted or modified. All of these variations are considered a part of the claimed invention.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The term "couple" relates to coupling a first component to a second component either directly or indirectly through an intermediate component.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for estimating a property of an earth formation, the apparatus comprising:

a carrier configured to be conveyed through a borehole penetrating the formation;

a single probe configured to be extended from the carrier and to seal with a wall of the borehole;

a fluid analysis sensor disposed at the carrier and configured to sense a property of a formation fluid sample extracted from the formation by the single probe;

a coring device disposed at the carrier and configured to extend into the single probe, to drill into the wall of the borehole, and to extract a core sample;

a core sample analysis sensor disposed at the carrier and configured to sense a property of the core sample;

an isolation door disposed at the single probe and configured to isolate the single probe from the coring device when the formation fluid sample is being extracted; and a processor configured to receive data from the fluid analysis sensor and the core sample analysis sensor and to estimate the property using the data.

2. The apparatus according to claim 1, further comprising a sealing pad disposed at the probe and configured to seal against the wall of the borehole.

3. The apparatus according to claim 2, further comprising:

an actuator configured to apply pressure to the pad against the wall of the borehole;

a sealing sensor configured to sense a force of the pad exerted against the wall of the borehole; and a controller configured to receive the sensed pad force and to output a control signal to the actuator in order to apply a pad force at or above a selected force setpoint.

4. The apparatus according to claim 1, further comprising one or more sample chambers, each sample chamber being configured to contain a formation fluid sample extracted through the probe and to maintain the extracted formation fluid sample at downhole pressure and temperature.

5. The apparatus according to claim 1, further comprising one or more core sample containers, each core sample container being configured to contain a core sample extracted through the probe and to maintain the extracted core sample at downhole pressure and temperature.

6. The apparatus according to claim 5, wherein the coring device comprises a piston configured to eject the core sample from a coring bit in the coring device into the one or more sample chambers.

7. The apparatus according to claim 5, wherein the one or more core sample containers comprise a plurality of core sample containers forming a rotary cassette of core sample containers.

8. The apparatus according to claim 1, wherein the fluid analysis sensor comprises at least one of a pressure sensor, a temperature sensor, a flow sensor, a reflective spectroscopy sensor, and a transmissive spectroscopy sensor.

9. The apparatus according to claim 1, further comprising a pump coupled to the probe and configured to extract the formation fluid sample through the probe.

10. The apparatus according to claim 1, wherein the core sample analysis sensor comprises at least one of a nuclear magnetic resonance sensor, an acoustic sensor, a radiation detector, a neutron source, and an electrical resistivity sensor.

11. The apparatus according to claim 1, further comprising a power operated isolation valve configured to isolate the fluid analysis sensor from the coring device when the core sample is being extracted.

12. The apparatus according to claim 1, wherein the coring device comprises a direct drive brushless electric motor configured to rotate a coring bit for drilling into the wall of the borehole.

13. The apparatus according to claim 1, wherein the coring device comprises a coring bit linear drive motor configured to urge a coring bit towards the wall of the borehole for drilling into the wall of the borehole.

14. The apparatus according to claim 1, wherein the coring device is configured to rotate from a drilling position in order to eject a core sample from a coring bit.

15. The apparatus according to claim 1, further comprising one or more downhole sensors disposed at the carrier and configured to sense one or more properties of the earth formation from the carrier.

16. The apparatus according to claim 15, wherein the processor is further configured to receive data from the one or more downhole sensors and to determine a depth in the formation at which to obtain the formation fluid sample and the core sample.

17. The apparatus according to claim 1, further comprising telemetry to communicate between downhole components of the apparatus and a surface processor disposed at the surface of the earth.

18. A method for estimating a property of an earth formation, the method comprising:

conveying a carrier through a borehole penetrating the earth formation;

extending a single probe from the carrier to a wall of the borehole and sealing to the wall of the borehole;

extracting a formation fluid sample through the single probe, wherein an isolation door disposed at the probe isolates the probe from a coring device when the formation fluid sample is being extracted;

analyzing the fluid sample using a fluid analysis sensor disposed at the carrier;

extracting a core sample from the earth formation through the single probe using the coring device;

analyzing the core sample using a core sample analysis sensor disposed at the carrier; and estimating the property using a processor that receives data from the fluid analysis sensor and the core sample analysis sensor.

19. The method according to claim 18, further comprising sensing one or more properties of the earth formation using one or more downhole sensors disposed at the carrier and determining a depth in the formation at which to obtain the formation fluid sample and the core sample.

* * * * *